US006777607B2

(12) United States Patent
Smith

(10) Patent No.: US 6,777,607 B2
(45) Date of Patent: Aug. 17, 2004

(54) MOVING TEMPERED MUSIC SCALE METHOD AND APPARATUS

(75) Inventor: Jack W. Smith, Belle Haven, VA (US)

(73) Assignee: Paul Reed Smith Guitars, Limited Partnership, Stevensville, MD (US)

( * ) Notice: Subject to any disclaimer, the term of this patent is extended or adjusted under 35 U.S.C. 154(b) by 18 days.

(21) Appl. No.: 10/195,073

(22) Filed: Jul. 15, 2002

(65) Prior Publication Data

US 2003/0033925 A1 Feb. 20, 2003

Related U.S. Application Data

(62) Division of application No. 09/430,294, filed on Oct. 29, 1999, now Pat. No. 6,448,487.

(60) Provisional application No. 60/106,150, filed on Oct. 29, 1998.

(51) Int. Cl.[7] ..... G10H 1/38; G10H 5/00

(52) U.S. Cl. ..... 84/669; 84/609; 84/613; 84/637; 84/649

(58) Field of Search ..... 84/601–602, 609–613, 84/615–616, 634–637, 649–650, 653–654, 666–669

(56) References Cited

U.S. PATENT DOCUMENTS

| | | | | | |
|---|---|---|---|---|---|
| RE29,144 | E | * | 3/1977 | Bunger | 84/637 |
| 4,152,964 | A | | 5/1979 | Waage | |
| 4,248,119 | A | | 2/1981 | Yamada | |
| 4,397,209 | A | * | 8/1983 | Deforeit | 84/637 |
| 4,419,916 | A | | 12/1983 | Aoki | |
| 4,434,696 | A | | 3/1984 | Conviser | |
| 4,449,437 | A | * | 5/1984 | Cotton et al. | 84/613 |
| 4,498,363 | A | | 2/1985 | Shimada et al. | |
| 4,635,517 | A | | 1/1987 | Nagashima et al. | |
| 4,860,624 | A | | 8/1989 | Dinnan et al. | |
| 5,056,398 | A | | 10/1991 | Adamson | |
| 5,117,727 | A | | 6/1992 | Matsuda | |
| 5,440,756 | A | | 8/1995 | Larson | |
| 5,442,129 | A | | 8/1995 | Mohrlok et al. | |
| 5,501,130 | A | | 3/1996 | Gannon et al. | |
| 5,736,661 | A | | 4/1998 | Armstrong | |
| 5,977,472 | A | * | 11/1999 | Ito et al. | 84/637 |
| 6,448,487 | B1 | * | 9/2002 | Smith | 84/669 |

* cited by examiner

*Primary Examiner*—Marlon Fletcher
(74) *Attorney, Agent, or Firm*—Barnes & Thornburg LLP

(57) ABSTRACT

A musical instrument and a method of operating it. An instrument and method which retunes and adjusts volumes in response to the chord being sustained and the way that chord is voiced. The instrument is capable of producing tones, the intervals between which are equal tempered intervals of a twelve note octave, and tones, the intervals between at least some of which are determined by identifying at least selected ones of the notes the instrument is being commanded to produce. The method includes identifying the at least selected ones of the notes the instrument is being commanded to produce, providing a map for mapping the identified notes to a chord type, identifying a note in that chord type, and substituting a frequency closer to a harmonic of the identified note for the frequency of at least one harmonic of at least one other note the instrument is being commanded to produce.

22 Claims, 3 Drawing Sheets

MOVING TEMPERED MUSIC SCALE METHOD AND APPARATUS

RELATED APPLICATIONS

This application is a divisional of U.S. Ser. No. 09/430,294 filed Oct. 29, 1999 now U.S. Pat. No. 6,448,487, which is based upon U.S. Ser. No. 60/106,150 filed Oct. 29, 1998. The disclosure of U.S. Ser. No. 60/106,150 is incorporated herein by reference.

FIELD OF THE INVENTION

This invention relates to algorithms and devices for use in producing music. It is disclosed in the context of an instrument including a keyboard, but is believed to have utility for any other polyphonic instrument or in other applications as well.

BACKGROUND OF THE INVENTION

For centuries musicians and mathematicians attempted to find a way of scaling a limited number of notes so that natural harmonics could be preserved, while melodies and harmonies were pitched at different levels, i.e., played in different keys. Many ways of tuning 12-note scales (12 notes per octave) were tried. All produced annoying dissonances and/or severely limited the keys (pitches) in which a piece could be played and the harmonic intervals which could be used. 13-note scales were tried (D# and Eb were different notes) to provide more consonant intervals. Fourteen-note scales were also tried, and Handel even invented an instrument with a 70-note scale but could find no one who could play it. Finally, the compromise twelve tone, equal tempered scale was adopted. In this scale, all intervals except the octaves are dissonant, but music played in different keys retains the same interval relationships because the scale is a geometric progression. Even though this scale has now been in use for over two centuries, many musicians still find the dissonances produced by the scale to be annoying. String quartets eliminate some dissonances by tuning to each other, and find it difficult to play with pianos, which are generally tuned in equal tempered tuning. Likewise, the voices of barbershop quartets tune to each other, but almost always perform unaccompanied.

Several methods and apparatus are known which modify the equal tempered musical scale. There are, for example, the methods and apparatus described in U.S. Pat. Nos. 4,152,964; 4,248,119; 5,501,130; and, 5,736,661.

DISCLOSURE OF THE INVENTION

According an aspect of the invention, an instrument is provided which retunes itself in response to the chord being sustained and the way that chord is voiced.

According to another aspect of the invention, an instrument is provided which retunes itself in response to the chord being sustained and the separation of the notes in the chord.

According to another aspect of the invention, an instrument is provided which blends the notes of a chord the instrument is playing in view of the chord being sustained and its voicing.

According to another aspect of the invention, an instrument is provided which blends the notes of a chord the instrument is playing in view of the chord being sustained and the separation of the notes in the chord.

According to another aspect of the invention, an instrument is provided which retunes itself in view of the chord being sustained and the way talented musicians in ensembles tune to each other.

According to another aspect of the invention, a method is provided to develop alternative methods to retune the notes of a keyboard in view of the harmonics of contention, that is, harmonics that are separated typically by more than about one and one-half cents and less than about thirty-five cents apart, produced by the notes of the chord.

According to another aspect of the invention, a method is provided to produce consonant harmonics on a keyboard with equal tempered stretch tuning.

According to another aspect of the invention, a method is provided to obtain the consensus of experts as to the most desirable strategies for tuning different styles of music.

According to another aspect of the invention, a method is provided to obtain the consensus of experts as to the most desirable strategies for blending notes of a chord.

According to another aspect of the invention, a method is provided to obtain the consensus of experts as to the most desirable strategies for tuning in view of the kind(s) of ensemble(s) which is (are) performing (a) musical composition(s).

According to one aspect of the invention, a method of retuning a keyboard-type instrument starts from, and returns to, equal tempered stretch tuning based on the type of chord being sustained and the voicing of the chord.

According to another aspect of the invention, a method for generating harmonics for stretched tuning preserves consonance of harmonics.

According to yet another aspect of the invention, a method for retuning a keyboard type instrument is based on the chord type being played and the way the chord is voiced.

According to yet another aspect of the invention, a method is provided for determining which notes should be tuned as a sustained chord and which notes should be treated as passing notes.

According to yet another aspect of the invention, a method is provided for implementing options for how sustained chords can be retuned to eliminate dissonances and generate enhanced overtones.

According to yet another aspect of the invention, a method is provided for permitting musicians to select tuning strategies from combinations of options.

According to yet another aspect of the invention, a method is provided for retuning based on the chords, for example, 2-note chords, 3-note chords, 4-note chords, 5-note chords, created by the sustained notes.

According to yet another aspect of the invention, a method is provided for retuning based on the history of sustained notes.

According to yet another aspect of the invention, a method is provided for retuning based on tuning options as indicated by the setting of switches.

According to yet another aspect of the invention, a method is provided for tuning based on the length of time notes have been sustained and the interval positions they serve.

According to yet another aspect of the invention, a method is provided for starting from, and returning to equal tempered tuning based on the chord type being sustained, the voicing of the chord, and choices among options that have been made by experts.

According to yet another aspect of the invention, a method is provided for blending sustained chords so that no note stands out.

According to yet another aspect of the invention, a method is provided for retuning instruments so that they will closely approximate the way musicians and ensembles typically tune to each other.

According to an other aspect of the invention, a musical instrument includes a first switch having a first position in which the instrument is capable of producing tones, the intervals between which are equal tempered intervals of a twelve note octave. The first switch has a second position in which the instrument is capable of producing tones, the intervals between at least some of which are determined by identifying at least selected ones of the notes the instrument is being commanded to produce. The instrument also includes a processor including a map by which the identified notes are mapped to a chord type. The processor identifies a note in that chord type and substitutes a frequency closer to a harmonic of the identified note for the frequency of at least one harmonic of at least one other note the instrument is being commanded to produce.

Illustratively according to this aspect of the invention, the instrument includes a second switch. The processor includes at least two different maps. The second switch has a position for each map, permitting selection of one of the at least two different maps by which the instrument maps the identified intervals to a chord type.

Further illustratively according to this aspect of the invention, the instrument includes a third switch. The processor includes at least two different chord type decision engines. The third switch has a position for each chord type decision engine, permitting selection of one of the at least two different decision engines by which the instrument identifies a note of the chord type.

Additionally illustratively according to this aspect of the invention, the processor is a processor for substituting a frequency within a predetermined range of a harmonic of the identified note for the frequency of at least one harmonic of at least one other note the instrument is being commanded to produce.

Illustratively according to this aspect of the invention, the processor is a processor for substituting frequencies closer to at least two harmonics of the identified note for the frequencies of harmonics of at least two other notes the instrument is being commanded to produce.

Further illustratively according to this aspect of the invention, the processor is a processor for substituting frequencies closer to at least two harmonics of the identified note for the frequencies of at least two harmonics of at least one other note the instrument is being commanded to produce.

Additionally illustratively according to this aspect of the invention, the processor is a processor for permitting mapping of the identified notes to at least one of: a major triad; a minor triad; a triad suspended by a second; a triad suspended by a fourth; a major sixth; a minor sixth; a major seventh; a minor major seventh; a dominant seventh; a minor dominant seventh; a half diminished chord; a full diminished chord; and, an augmented chord.

Illustratively according to this aspect of the invention, the processor is a processor for resolving contention among competing ones of: a major triad; a minor triad; a triad suspended by a second; a triad suspended by a fourth; a major sixth; a minor sixth; a major seventh; a minor major seventh; a dominant seventh; a minor dominant seventh; a half diminished chord; a full diminished chord; and, an augmented chord, and mapping according to the contention resolution.

Further illustratively according to this aspect of the invention, the instrument includes a second switch. The processor includes at least two different chord type contention resolutions. The second switch has a position for each chord type contention resolution, permitting selection of one of the at least two different chord type contention resolutions by which the instrument identifies the chord type.

Additionally illustratively according to this aspect of the invention, the the processor is a processor for permitting mapping of the identified notes to an inversion of the chord.

Illustratively according to this aspect of the invention, the instrument includes a second switch. The processor includes a substitution decision engine. The second switch has a position in which the substitution decision engine is disabled and a position in which the substitution decision engine is enabled.

Further illustratively according to this aspect of the invention, the substitution decision engine has as an input at least one of: how long the instrument is commanded to sustain one of the twelve notes; the history of accumulated time of uninterrupted sustainment of a sustained note; the position a sustained note occupies in a chord; the position a sustained note occupied in a chord on at least one prior occasion; and, how much the note's current assigned frequency varies from equal-tempered tuning.

Additionally illustratively according to this aspect of the invention, the the processor includes a lookup table by which the identified notes are mapped to a chord type, by which a note of the chord type is identified, and/or by which a frequency closer to a harmonic of the identified note is substituted for the frequency of at least one harmonic of at least one other note the instrument is being commanded to produce.

Illustratively according to this aspect of the invention, the instrument includes a keyboard having multiple keys for producing tones which are octaves of the at least one harmonic of the at least one other note the instrument is being commanded to produce. The processor substitutes octaves of the frequency closer to a harmonic of the identified note for the octaves of the frequency of at least one harmonic of the at least one other note the instrument is being commanded to produce.

Further illustratively according to this aspect of the invention, the processor includes a substitution decision engine having as an input how long the instrument is commanded to sustain one of the twelve notes. The processor reassigns the keys to producing tones which are octaves of the at least one harmonic of the at least one other note the instrument is being commanded to produce when the instrument is no longer commanded to sustain one of the twelve notes.

Additionally illustratively according to this aspect of the invention, the the processor is a processor for adjusting the amplitude of the frequency closer to a harmonic of the identified note which is substituted for the frequency of at least one harmonic of at least one other note the instrument is being commanded to produce.

Illustratively according to this aspect of the invention, the processor is a processor for adjusting the amplitudes of more than one of the tones the instrument produces in response to the commands to produce.

Further illustratively according to this aspect of the invention, the instrument includes a second switch. The processor includes at least two different amplitude decision engines. The second switch has a position for each amplitude decision engine, permitting selection of one of the at least two different amplitude engines by which the instrument adjusts the amplitudes of the tones.

According to another aspect of the invention, a musical instrument includes a first switch having a first position in which the instrument is capable of producing tones, the amplitudes of which are determined by identifying at least selected ones of the notes the instrument is being commanded to produce. The instrument further includes a processor including a map by which the identified notes are mapped to a chord type. The processor identifies a note in that chord type, and adjusts the amplitude of at least one of the tones the instrument produces in response to the commands to produce in response to the identified note.

Illustratively according to this aspect of the invention, the first switch has a second position in which the amplitude of the at least one tone the instrument produces in response to the commands to produce is not adjusted.

Further illustratively according to this aspect of the invention, the processor is a processor for adjusting the amplitudes of more than one of the tones the instrument produces in response to the commands to produce in response to the identified note when the first switch is in the first position.

According to another aspect of the invention, a method of operating a musical instrument capable of producing tones, the intervals between which are equal tempered intervals of a twelve note octave, and tones, the intervals between at least some of which are determined by identifying at least selected ones of the notes the instrument is being commanded to produce, includes identifying the at least selected ones of the notes the instrument is being commanded to produce, providing a map for mapping the identified notes to a chord type, identifying a note in that chord type, and substituting a frequency closer to a harmonic of the identified note for the frequency of at least one harmonic of at least one other note the instrument is being commanded to produce.

Illustratively according to this aspect of the invention, the method further includes providing at least two different maps, and selecting one of the at least two different maps by which the identified intervals are mapped to a chord type.

Further illustratively according to this aspect of the invention, the method includes providing at least two different chord type decision engines, and selecting one of the at least two different decision engines by which the instrument identifies a note of the chord type.

Illustratively according to this aspect of the invention, substituting a frequency closer to a harmonic of the identified note for the frequency of at least one harmonic of at least one other note the instrument is being commanded to produce includes substituting a frequency within a predetermined range of a harmonic of the identified note for the frequency of at least one harmonic of at least one other note the instrument is being commanded to produce.

Further illustratively according to this aspect of the invention, the method includes substituting frequencies closer to at least two harmonics of the identified note for the frequencies of harmonics of at least two other notes the instrument is being commanded to produce.

Additionally illustratively according to this aspect of the invention, the method includes substituting frequencies closer to at least two harmonics of the identified note for the frequencies of at least two harmonics of at least one other note the instrument is being commanded to produce.

Illustratively according to this aspect of the invention, providing a map for mapping the identified notes to a chord type includes providing a map for mapping the identified notes to at least one of a major triad, a minor triad, a triad suspended by a second, a triad suspended by a fourth, a major sixth, a minor sixth, a major seventh, a minor major seventh, a dominant seventh, a minor dominant seventh, a half diminished chord, a full diminished chord, and an augmented chord.

Further illustratively according to this aspect of the invention, the method includes resolving contention among competing ones of a major triad, a minor triad, a triad suspended by a second, a triad suspended by a fourth, a major sixth, a minor sixth, a major seventh, a minor major seventh, a dominant seventh, a minor dominant seventh, a half diminished chord, a full diminished chord, and an augmented chord, and mapping according to the contention resolution.

Additionally illustratively according to this aspect of the invention, the method includes providing at least two different chord type contention resolutions, and permitting selection of one of the at least two different chord type contention resolutions by which the instrument identifies the chord type.

Illustratively according to this aspect of the invention, providing a map for mapping the identified notes to a chord type includes providing a map for mapping the identified notes to an inversion of the chord.

Further illustratively according to this aspect of the invention, the method includes providing a substitution decision engine, and selectively enabling the substitution decision engine.

Additionally illustratively according to this aspect of the invention, the method includes providing as an input at least one of: how long the instrument is commanded to sustain one of the twelve notes; the history of accumulated time of uninterrupted sustainment of a sustained note; the position a sustained note occupies in a chord; the position a sustained note occupied in a chord on at least one prior occasion; and how much the note's current assigned frequency varies from equal-tempered tuning.

Illustratively according to this aspect of the invention, the method includes providing a lookup table by which the identified notes are mapped to a chord type, by which a note of the chord type is identified, and/or by which a frequency closer to a harmonic of the identified note is substituted for the frequency of at least one harmonic of at least one other note the instrument is being commanded to produce.

Illustratively according to this aspect of the invention, the instrument includes a keyboard having multiple keys for producing tones which are octaves of the at least one harmonic of the at least one other note the instrument is being commanded to produce. The method includes substituting octaves of the frequency closer to a harmonic of the identified note for the octaves of the frequency of at least one harmonic of the at least one other note the instrument is being commanded to produce.

Further illustratively according to this aspect of the invention, the method includes providing a substitution decision engine having as an input how long the instrument is commanded to sustain one of the twelve notes, and reassigning the keys to producing tones which are octaves of the at least one harmonic of the at least one other note the instrument is being commanded to produce when the instrument is no longer commanded to sustain one of the twelve notes.

Additionally illustratively according to this aspect of the invention, the method includes adjusting the amplitude of the frequency closer to a harmonic of the identified note which is substituted for the frequency of at least one harmonic of at least one other note the instrument is being commanded to produce.

Illustratively according to this aspect of the invention, the method includes providing at least two different amplitude decision engines, and selecting one of the at least two different amplitude engines by which the instrument adjusts the amplitude of the frequency.

Further illustratively according to this aspect of the invention, the method includes adjusting the amplitudes of more than one of the tones the instrument produces in response to the commands to produce.

According to another aspect of the invention, a method of operating a musical instrument capable of producing tones, the amplitudes of which are determined by identifying at least selected ones of the notes the instrument is being commanded to produce, includes providing a map by which the identified notes are mapped to a chord type, identifying a note in that chord type, and adjusting the amplitude of at least one of the tones the instrument produces in response to the commands to produce in response to the identified note.

Illustratively according to this aspect of the invention, the method includes selectively maintaining unadjusted the amplitude of the at least one tone the instrument produces in response to the commands to produce.

Further illustratively according to this aspect of the invention, the method includes adjusting the amplitudes of more than one of the tones the instrument produces in response to the commands to produce in response to the identified note when the first switch is in the first position.

According to another aspect of the invention, notes being played on a keyboard are classified into one of two categories: members of a sustained chord; or, passing notes.

A keyboard which incorporates the methods of this invention when used to accompany, or be a member of, an ensemble of tunable instruments, for example, bowed instruments such as violins and cellos, brass instruments, reed instruments, and human voices, will reduce clashes/inconsistencies between the harmonies the keyboard produces and those produced by the musicians who naturally tune to each other to reduce some of the most undesirable dissonances, generate brilliant overtones, and produce harmonies consistent with those produced by ensembles. When such an instrument is used to perform solos, it will produce music which is more pleasing because certain undesirable beat notes will be eliminated and the harmonies produced will be like those typically found by discriminating musicians to be more pleasing. Such an instrument uses an equal tempered scale as an underlying basis, as a point of departure and as a point of return.

BRIEF DESCRIPTION OF THE DRAWINGS

The invention may best be understood by referring to the following detailed description and accompanying drawings which illustrate various aspects of the invention. In the drawings.

DETAILED DESCRIPTIONS OF ILLUSTRATIVE EMBODIMENTS

Figure 1:
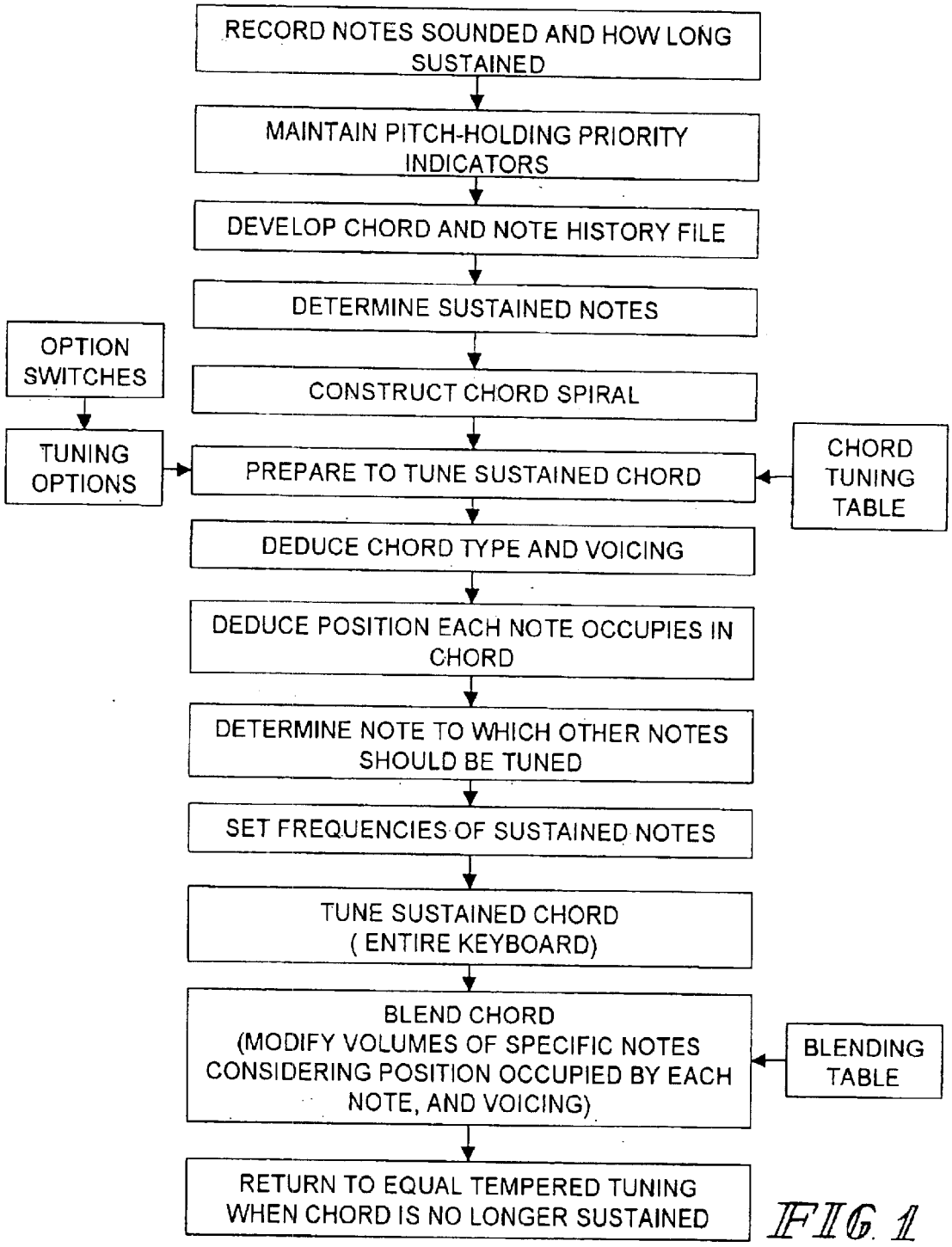
FIG. 1 illustrates a flowchart of an algorithm to identify, tune and blend sustained chords.

"Voicing" is the term sometimes used in this description to indicate the order, lowest to highest, of the interval positions in a chord, and their spread, for example, their separation by skipping octaves. An asterisk (*) is generally used to indicate a skipped octave. A "cent" is generally used to describe 1/1200 of an octave or 1/100 of a semitone or $(2\times S)^{1/1200}$. The symbol "¢" is often used as an abbreviation for this. "Maj" is the term sometimes used in this description to indicate a major triad. "Mi" is the term sometimes used in this description to indicate a minor triad. "Dim" is the term sometimes used in this description to indicate a diminished triad. "Dim 7" is the term sometimes used in this description to indicate a full diminished $7^{th}$. "½ Dim" is the term sometimes used in this description to indicate a half diminished $7^{th}$. "Dom 7" is the term sometimes used in this description to indicate a dominant $7^{th}$. "Ma 6" is the term sometimes used in this description to indicate a major $6^{th}$. "Mi 6" is the term sometimes used in this description to indicate a minor $6^{th}$ "Aug" is the term sometimes used in this description to indicate an augmented chord. "dom 7+9" is the term sometimes used in this description to indicate a dominant 7th with added $9^{th}$. "9" is the term sometimes used in this description to indicate a $9^{th}$ chord. The person of ordinary skill in the art will immediately appreciate that other chords are possible, and that there are common, immediately recognizable symbols which designate many of those. Wherever any such chord is mentioned herein, I have endeavored to use a common description of it.

Where the role played by a note in a chord is that of the root or its octaves, the note is sometimes designated in this description with a Roman numeral "I." Where the role played by a note in a chord is that of second or its octaves (including the ninth), the note is sometimes designated in this description with a Roman numeral "II." Where the role played by a note in a chord is that of minor third or its octaves, the note is sometimes designated in this description with a Roman numeral "IIIb."Where the role played by a note in a chord is that of major third or its octaves, the note is sometimes designated in this description with a Roman numeral "III." Where the role played by a note in a chord is that of fourth or its octaves (including the eleventh), the note is sometimes designated in this description with a Roman numeral "IV." Where the role played by a note in a chord is that of the fifth or its octaves, the note is sometimes designated in this description with a Roman numeral "V." Where the role played by a note in a chord is that of augmented fifth or its octaves, the note is sometimes designated in this description with a Roman numeral "V+." Where the role played by a note in a chord is that of sixth or its octaves, including the thirteenth, the note is sometimes designated in this description with a Roman numeral "VI." Where the role played by a note in a chord is that of flatted, or dominant, seventh, or its octaves, the note is sometimes designated in this description with a Roman numeral "VIIb." Where the role played by a note in a chord is that of major seventh, or its octaves, the note is sometimes designated in this description with a Roman numeral "VII."

An instrument constructed and operated according to the invention starts from an equal tempered scale and retunes the whole keyboard virtually in real time based on the type of chord which is being played and the way the chord is voiced. It returns to equal tempered tuning when the particular chord to which it has tuned itself is no longer being sustained.

The keyboard is initially tuned to equal tempered stretch tuning. Starting from a base frequency such as $A_4$=440 Hz, every semitone in the scale is set equal to its predecessor multiplied by $(2\times S)^{1/12}$, where S is the stretch constant, typically set so that $1 \leqq S \leqq 1.003$. Whenever a chord is sustained for a threshold amount of time, then notes in the sustained chord are retuned together with all like notes in the entire keyboard. The threshold value depends on the history of sustained notes. The longer a note or chord has been sustained, then the longer a new note added to the chord must be sustained before it is considered to be more than a passing note. Passing notes do not affect the retuning of the keyboard. Sustained two-note, 3-note, 4-note and 5-note chords are retuned. Retuned sustained chords will always contain one note (typically the root) which is in equal tempered tuning.

The user can choose from among a number of optional tuning strategies, each developed to closely match tunings actually created by different kinds of ensembles for different kinds of music.

A number of systems/methods have been devised for retuning an equal tempered scale during a performance. But these systems have produced harmonics based on structured systems such as just tuning. Instruments according to the present invention retune to closely approximate the way musicians and ensembles tend to tune to each other to eliminate undesirable dissonances and create brilliant overtones, while keeping harmonic relationships consistent with their interpretation of the music and the consistency of the tuning with the type of music being played.

The keyboard is retuned, that is, the whole scale is reconstituted, almost instantaneously, whenever two or more notes are sounded together for an amount of time, for example, ⅕ of a second. For example, if middle G and the D above it are sounded together and sustained for the specified amount of time, then in order to eliminate the dissonances that exist in the equal tempered scale between G and D, either all Gs in the keyboard will be flatted or all Ds will be sharped, and the whole spectrum of harmonics associated with those tones will also be sharped or flatted proportionally.

The $3^{rd}$ harmonic of $G_3$ is 588.00 cycles per second. The $2^{nd}$ harmonic of $D_4$ is 587.34 cycles per second. When G and D are sounded together, these two harmonics produce a beat note of 0.66 cycles per second. A slight retuning can make these two harmonics coincide exactly, eliminating the beat note and reinforcing the harmonics. One tuning adjustment often causes other harmonics (not simply octaves apart) to coincide and reinforce. In the case cited above, the 9th harmonic of the G, which is an A, and the 6th harmonic of the D coincide as the result of retuning to make the 3rd harmonic of G, which is a D, coincide with the 2nd harmonic of D. The scale can be retuned for this interval by sharping all Ds and all the harmonics generated by those notes by the ratio 588÷587.34.

Table I illustrates the equal tempered frequencies of the fundamentals of the notes in a G dom 7 chord, together with harmonics, and indicates harmonics which can be made to coincide by retuning the other notes of the chord. The frequencies of each note are shown for three octaves, so that combinations of different rows can represent different voicings of the chord. Some frequencies which could be retuned to eliminate dissonances are underlined. For example, the $11^{th}$ harmonic of the lowest octave of B and the $7^{th}$ harmonic of the middle octave of G differ by only 17¢.

| | G Dominant 7TH CHORD Harmonic: | | | | | | | | | | | | | |
|---|---|---|---|---|---|---|---|---|---|---|---|---|---|---|
| | 1st | 2nd | 3rd | 4th | 5th | 6th | 7th | 8th | 9th | 10th | 11th | 12th | 13th | 14th |
| Fundamental | | | | | | | | | | | | | | |
| Note: | | | D | | B | D | (F)** | | A | | | D | | (F)** |
| | 98.00 | 196.00 | 294.00 | 392.00 | 490.00 | 588.00 | 686.00 | 784.00 | 882.00 | 980.00 | 1078.00 | 1176.00 | 1274.00 | 1372.00 |
| G | 196.00 | 392.00 | 588.00 | 784.00 | 980.00 | 1176.00 | 1372.00 | 1568.00 | 1764.00 | 1960.00 | 2156.00 | 2352.00 | 2548.00 | 2744.00 |
| | 392.00 | 784.00 | 1176.00 | 1568.00 | 1960.00 | 2352.00 | 2744.00 | 3136.00 | 3528.00 | 3920.00 | 4312.00 | 4704.00 | 5096.00 | 5488.00 |
| | | | | B | | | | B | | | | | | |
| | 123.47 | 246.94 | 370.41 | 493.88 | 617.34 | 740.81 | 864.28 | 987.75 | 1111.21 | 1234.70 | 1358.17 | 1481.64 | 1605.11 | 1728.58 |
| B | 246.94 | 493.87 | 740.81 | 987.75 | 1234.68 | 1481.62 | 1728.55 | 1975.49 | 2222.42 | 2469.40 | 2716.34 | 2963.28 | 3210.22 | 3457.16 |
| | 493.88 | 987.74 | 1481.62 | 1875.50 | 2469.36 | 2963.24 | 3457.10 | 3950.98 | 4444.84 | 4938.80 | 5432.68 | 5926.56 | 6420.44 | 6914.32 |
| | | D | | D | | A | | D | | | | A | | |
| | 146.84 | 293.67 | 440.00 | 587.34 | 734.18 | 881.00 | 1028.35 | 1174.68 | 1321.52 | 1468.40 | 1615.24 | 1762.08 | 1908.92 | 2055.76 |
| D | 293.67 | 587.34 | 880.00 | 1174.68 | 1468.35 | 1762.00 | 2055.69 | 2349.36 | 2643.03 | 2936.70 | 3230.48 | 3524.16 | 3817.84 | 4111.52 |
| | 587.34 | 1174.68 | 1760.00 | 2349.36 | 2936.70 | 3524.00 | 4111.38 | 4698.72 | 5286.06 | 5873.40 | 6460.96 | 7048.32 | 7635.68 | 8223.04 |
| | | F | | F | | | | F | | | | | | |
| | 174.62 | 349.23 | 523.85 | 698.47 | 873.08 | 1047.70 | 1222.32 | 1396.98 | 1571.55 | 1746.20 | 1920.77 | 2095.38 | 2270.00 | 2444.61 |
| F | 349.23 | 698.46 | 1047.70 | 1396.93 | 1746.16 | 2095.39 | 2444.63 | 2793.96 | 3143.09 | 3492.30 | 3841.53 | 4190.76 | 4539.99 | 4889.22 |
| | 698.46 | 1396.92 | 2095.40 | 2793.86 | 3492.32 | 4190.78 | 4889.26 | 5587.92 | 6286.18 | 6984.60 | 7683.06 | 8381.52 | 9079.98 | 9778.44 |

**The seventh harmonic is so much flatter than its corresponding equal-tempered note that it is given a special name (harmonic minor 7th) and is often bracketed by parentheses.

FIG. 1 illustrates a flowchart of an algorithm to identify, tune and blend sustained chords. In decision block 10, the algorithm determines which keyboard keys are being sustained, for example, by being depressed and held, or by (a) sustaining pedal(s), or by rapid repetition. The specific notes struck, the time they were struck, and the time they were released, that is, no longer sustained, are computed and recorded. This information is sent to decision blocks 12, 13 and 14.

In decision blocks 12, 13 and 14 an algorithm accumulates future pitch-holding priority points as time of uninterrupted sustainment of a sustained note increases, and as the percentage of that time that the sustained note was the I or V of a chord. The priority points may be assigned, for example, as follows. Each note accumulates the number of milliseconds since its uninterrupted current sustaining period began. Also recorded are the milliseconds it accumulated while the I of a chord, the milliseconds it accumulated while the V of a chord, and the position it last occupied in the chord. Every pair of sustained notes and every triplet of sustained notes, and every quadruplet of sustained notes constitute a sustained chord. Each sustained chord accumulates sustained milliseconds and the milliseconds sustained when one of its members was the I of the chord, or the V of the chord and the milliseconds when both members of the chord were the I or the V. As two or more notes accumulate pitch-holding points, the chords they form accumulate pitch-holding points which can build to the point that a variety of short-duration changes can pass by or through these 2-note chords without affecting their pitch by more than a threshold value.

When a new chord is formed and a previously sustained note is part of that chord, its accumulated pitch holding points are a factor in determining whether its pitch will be held, and thus whether other notes will be tuned to it. Other factors which will influence whether its pitch will be held through a new chord of which it is a part include the role it plays in the new chord, how much its current assigned pitch varies from equal-tempered tuning, and its voicing position in the new chord, for example, whether it is the lowest note, the next next lowest note, and so on to the highest note. The overall effect will be that while a chord is being sustained, one note in the chord, for example, the I note, will always be within a desired number, T, of cents from equal tempered tuning, where T may be set equal to, for example, two cents.

Figure 2:
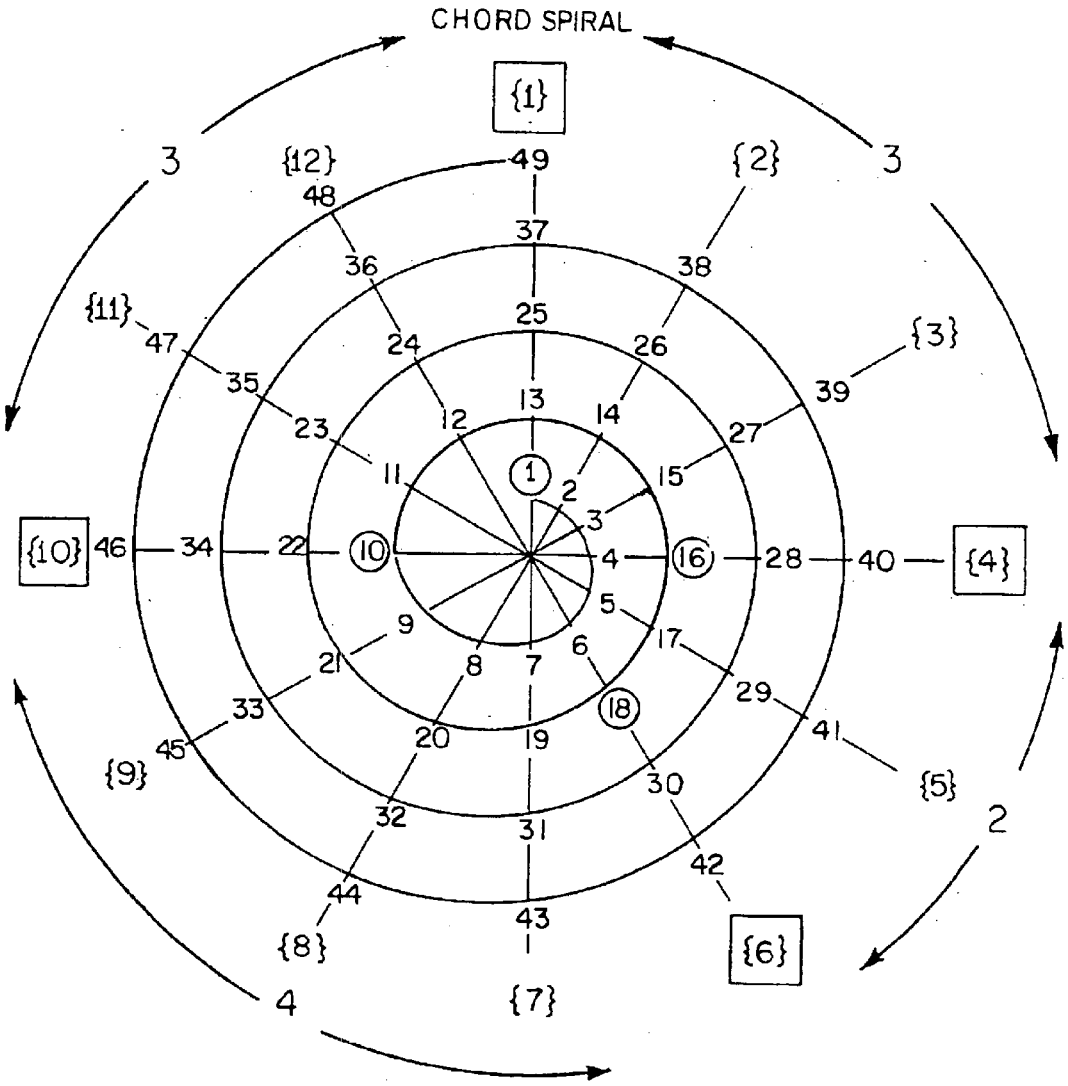
FIG. 2 is a chord spiral illustrating a method and algorithm by which the type of chord being produced, the positions occupied by the notes of the chord, and the way the chord is voiced can be determined.

Tuning and blending are different functions concerned with different domains. The tuning process involves retuning an entire keyboard to the frequencies of retuned notes in sustained chords. The blending function is concerned with the volumes of the individual notes sounding in a chord. The blending function typically will operate only when activated, for example, by a pedal which returns to the "OFF" position when it is not depressed. Given a sequence of notes, both the tuning and blending functions require that the chord type they constitute, the voicing of the chord, and the role each note plays in the chord all be determined. This is accomplished by using an algorithm and modulo-12 arithmetic which are illustrated in FIG. 2, the chord spiral and the methods disclosed herein.

As previously noted, a method according to the invention starts from, and returns to, equal tempered tuning with natural sharping which means that the frequency of each semitone is equal to $(2S)^{1-12}$ times its predecessor semitone, where S is a "stretch," or sharping, constant close to unity, typically set between 1 and 1.003, for example, 1.002. Such a stretch constant is used, for example, to progressively sharp the tones in the scale as frequency increases, to counteract the tendency of tones to sound progressively flatter as frequency increases. When sustained chords are encountered, the notes of that chord and all like notes in the entire keyboard are retuned to make the shared harmonics coincide. For example, if the chord is a 2-note open fifth, then the frequency of the I is held at its original equal tempered tuning, while the frequency of V and all its octaves on the keyboard are retuned so that its $2^{nd}$ harmonic coincides precisely with the $3^{rd}$ harmonic of I. When the chord is no longer sustained, the note that had been V and all its octaves on the keyboard return to equal tempered stretch tuning.

These algorithms, software, firmware and other devices implementing them, can generate notes where the harmonics are in the relationship $f_n=(2\times S)^{\log_2 n}$, where n is a positive integer 1, 2, 3 . . . T, and T is a threshold that depends on the instruments which can be simulated by the keyboard, but is generally set≦17. This method of generating harmonics permits the user to select a value of S which will determine to what extent higher harmonics are sharper than lower ones.

For any value of S≧1, the function produces harmonics within a given note which are consonant in the same way harmonics are consonant with the function, which is often assumed, $f_n=f_1\times n$ where $f_n$ is the $n^{th}$ harmonic of a given note, n is a positive integer, and $f_1$ is the fundamental frequency of the note. In other words, using the formula $f_n=f_1\times(2\times S)^{\log_2 n}$ the harmonics of a given note reinforce and do not produce annoying sounds because $f_n/f_m=f_{2n}/f_{2m}=f_{3n}/f_{3m}=\ldots f_{kn}/f_{km}$ where $f_n$ and $f_m$ are the $n^{th}$ and $m^{th}$ harmonic and k is a positive integer that takes on the values 1, 2, 3, 4 . . . . Equal tempered tuning, when S≧1, is such that the frequency of every semitone is equal to its predecessor multiplied by $(2\times S)^{1/12}$.

To tune and/or blend a sustained chord, a method and apparatus according to the invention must identify the kind of a chord and the interval position each of the notes in the chord occupies. The chord spiral illustrated in FIG. 2 is intended to help clarify, simplify and illuminate an algorithm which will determine sustained chord types and the interval position occupied by each note in the chord. The chord spiral illustrates the relationships among notes along a scale of semitones and their relationships in an octave. The chord type and the interval position each note occupies in the chord are deduced from these relationships. The first position in the chord spiral, 1, represents the lowest note in a chord. On a chord spiral, relative ascending semitone positions are depicted on a spiral that successively passes through rays, indicated by curved brackets, {}, each of which represents the notes which are octaves above the semitone represented by the first intersection of the spiral with that ray. For example, ray {4} in FIG. 2 contains intersection positions for notes which are octaves above the note which is 3 semitones (a minor third) above the lowest note. The semitone positions along the spiral relative to the lowest note (position 1) are tallied with the appropriate note in the chord. Every ray that contains one or more specific note tallies is itself tallied. In the example illustrated in FIG. 2, tallied rays are: {1}, {4}, {6}, {10}. These rays correspond to semitone positions 1, 10, 16, 18. Semitone differences between tallied rays are then computed going around the spiral in a clockwise direction. The differences, or step lengths, in semitones, going around the rays clockwise starting from ray {1} are: 3, 2, 4, 3, a sequence, or signature, which indicates a particular order of the interval positions of a dom 7 chord. The lowest note is the V, the next higher is the III, followed by the VIIb, and finally, the I. The voicing of the chord as indicated by the positions tallied on the chord spiral illustrated in FIG. 2 is V, III, VIIb, I, with no skipped octaves illustrated. The absence of skipped octaves is indicated by the positions tallied on the chord spiral itself.

The sequence of intervals and the voicing information obtained from the chord spiral are used to determine the chord type and the interval each note occupies in the chord. Tables II and III below indicate how the same set of notes, voiced in different ways, can be interpreted as different chord types, and how the notes themselves can be interpreted to occupy different positions in a chord when they are voiced in different ways. One voicing, illustrated in Table II, implies a mi 6 chord. The other voicing, illustrated in Table III, implies a ½ dim chord.

TABLE II

ONE VOICING OF F, A♭, C and D WITH F BEING THE LOWEST NOTE

| | | | | | | | | | |
|---|---|---|---|---|---|---|---|---|---|
| Notes and Voicing | F | * | A♭ | C | | D | | | (F) |
| Spiral Numbers | 1 | | 16 | 20 | | 22 | | | (25) |
| Ray Numbers | {1} | | {4} | {8} | | {10} | | | |
| Interval Sequence | | 3 | 4 | | 2 | | 3 | | |
| Implied Chord Type | | | Minor 6th | | | | | | |
| Implied Interval Position of Each Note | I | | III♭ | V | | | VI | | |

Voicing: I, * III♭, V, VI
*indicates skipped octave. () indicates same note as 1st column.

TABLE III

A DIFFERENT VOICING OF F, A♭, C and D WITH D BEING THE LOWEST NOTE

| | | | | | | | | | |
|---|---|---|---|---|---|---|---|---|---|
| Notes and Voicing | D | | F | | A♭ | | C | | (D) |
| Spiral Numbers | 1 | | 4 | | 7 | | 11 | | 13 |
| Ray Numbers | {1} | | {4} | | {7} | | {11} | | {1}* |
| Interval Sequence | | 3 | | 3 | | 4 | | 2 | |
| Implied Chord Type | | | | | Half Diminished | | | | |
| Implied Interval Positions of Notes Voicing: I, III♭, V♭, VII♭ | I | | III♭ | | V♭ | | VII♭ | | I |

*Returning to {1}

The signature of a chord type is the sequence of intervals, or differences, going around the chord spiral in a clockwise direction with the position 1 representing the lowest note. For example, the signature of a ma 6 chord with voicing V, I, III, VI (V being the lowest note) is 2, 3, 4, 3. The signature of a maj with voicing III, V, I (the lowest note being III) is 3, 5, 4. A chord table which illustrates the interval sequences, or signatures, for many types of chords is Table III.

TABLE III

EXAMPLES OF MAPPINGS FROM ACTIVATED CHORD SPIRAL RAYS AND SEQENTIAL DIFFERENCES BETWEEN RAY NUMBERS TO CHORD TYPES

| Signature | Activated Rays | | | | | Chord Type |
|---|---|---|---|---|---|---|
| 4 3 5 | {1} | {5} | {8} | | | Major |
| 5 4 3 | {1} | {6} | {10} | | | Triad |
| 3 5 4 | {1} | {4} | {9} | | | |
| 3 4 5 | {1} | {4} | {8} | | | Minor |
| 5 3 4 | {1} | {6} | {9} | | | Triad |
| 4 5 3 | {1} | {5} | {10} | | | |
| 4 4 4 | {1} | {5} | {9} | | | Augmented |
| 5 2 5 | {1} | {6} | {8} | | | Sus(4) |
| 5 5 2 | {1} | {6} | {11} | | | |
| 2 5 5 | {1} | {3} | {8} | | | |
| 3 3 3 3 | {1} | {4} | {7} | {10} | | Full Dim 7 |
| 4 3 3 2 | {1} | {5} | {8} | {11} | | Dominant |
| 2 4 3 3 | {1} | {3} | {7} | {10} | | 7th |
| 3 2 4 3 | {1} | {4} | {6} | {10} | | |
| 3 3 2 4 | {1} | {4} | {7} | {9} | | |
| 4 3 4 1 | {1} | {5} | {8} | {12} | | Major |
| 1 4 3 4 | {1} | {2} | {6} | {9} | | 7th |
| 4 1 4 3 | {1} | {5} | {6} | {10} | | |
| 3 4 1 4 | {1} | {4} | {8} | {9} | | |
| 3 4 3 2 | {1} | {4} | {8} | {11} | | Minor |
| 3 2 3 4 | {1} | {4} | {6} | {9} | | 7th |
| 4 3 2 3 | {1} | {5} | {8} | {10} | | Major |
| 2 3 4 3 | {1} | {3} | {7} | {10} | | 6th |
| 2 2 3 3 2 | {1} | {3} | {5} | {8} | {11} | Dom 7 + 9 |
| 2 2 2 3 3 | {1} | {3} | {5} | {7} | {10} | |
| 3 2 2 2 3 | {1} | {4} | {6} | {8} | {10} | |
| 3 3 2 2 2 | {1} | {4} | {7} | {9} | {11} | |
| 2 3 3 2 2 | {1} | {3} | {6} | {9} | {11} | |

TABLE IV

EXAMPLES OF MAPPINGS FROM ACTIVATED CHORD SPIRAL RAY DIFFERENCES AND CHORD SPIRAL SEQUENCE POSITIONS TO COMPACTED VOICINGS AND SPREAD VERSIONS OF THOSE VOICINGS

| Chord Type | Activated Ray Difference Sequence | Chord Spiral Sequence Position | | | | Compacted Voicing | | | | Spread Versions of Voicing |
|---|---|---|---|---|---|---|---|---|---|---|
| Major Triad | 4 3 5 | 1 | 5 | 8 | | I | III | V | | |
| | | 1 | 17 | 20 | | | | | | I * III V |
| | | 1 | 17 | 32 | | | | | | I * III * V |
| | | 1 | 8 | 17 | | I | V | III | | |
| | | 1 | 8 | 29 | | | | | | I V * III |
| | 5 4 3 | 1 | 6 | 10 | | V | I | III | | |
| | | 1 | 18 | 22 | | | | | | V * I III |
| | | 1 | 10 | 18 | | V | III | I | | |
| | | 1 | 10 | 30 | | | | | | V III * I |
| | 3 5 4 | 1 | 4 | 9 | | III | V | I | | |
| | | 1 | 16 | 21 | | | | | | III * V I |
| | | 1 | 9 | 16 | | III | I | V | | |
| Dominant 7th | 4 3 3 2 | 1 | 5 | 8 | 11 | I | III | V | VII♭ | |
| | | 1 | 17 | 20 | 23 | | | | | I * III V VII♭ |

TABLE IV-continued

EXAMPLES OF MAPPINGS FROM ACTIVATED CHORD SPIRAL RAY DIFFERENCES AND CHORD SPIRAL SEQUENCE POSITIONS TO COMPACTED VOICINGS AND SPREAD VERSIONS OF THOSE VOICINGS

| Chord Type | Activated Ray Difference Sequence | Chord Spiral Sequence Position | Compacted Voicing | Spread Versions of Voicing |
|---|---|---|---|---|
| | 3 2 4 3 | 1 10 16 18 | V III VII♭ I | |
| | | 1 12 28 30 | | V * III VII♭ I |

TABLE V

EXAMPLE OF MAPPING OF CHORD SPIRAL TO CHORD VOICING AND TO POSITION IN CHORD WHICH EACH NOTE OCCUPIES

| | | | | | |
|---|---|---|---|---|---|
| Notes in Chord | G | E | B♭ | C | |
| Spiral Sequence Positions | 1 | 10 | 16 | 18 | |
| Rays Activated | {1} | {10} | {4} | {6} | |
| Columns Arranged in Ray Order | | | | | |
| Notes | G | B♭ | C | E | |
| Spiral Position | 1 | 16 | 18 | 10 | |
| Ray | {1} | {4} | {6} | {10} | {1}* |
| Ray Difference Sequence (going around clockwise) | 3 | 2 | 4 | 3 | |
| FROM DATABASE: Chord type is Dom 7. Interval Positions Which Match Difference Sequence | V | VII♭ | I | III | |
| Corresponding Notes | G | B♭ | C | E | |
| Corresponding Spiral Positions | 1 | 10 | 16 | 18 | |
| Voicing of Chord, from Chord Spiral Position Order is V, III, VII♭, I | | | | | |

*Return to {1}

The invention contemplates a keyboard which tunes itself the way musicians tune to each other, yet keeps equal tempered tuning as a point of departure and return. When musicians tune to each other, they take advantage of the tendency of harmonics which nearly coincide to lock together in sympathetic vibration. Therefore the tuning method herein employed searches for harmonics that contain threshold amounts of energy that almost coincide, thus providing an option to tune the notes to make those harmonics coincide exactly. Often there are choices. It is sometimes possible to flat a given note to make one of its energetic harmonics coincide with an energetic harmonic of another note in the chord, and it is also possible to sharp the given note to make one of its other energetic harmonics coincide with a different energetic harmonic of that other note or yet another note in the chord. Illustratively, the keyboard deviates only a tolerable degree from the expected harmonic ratios that arise from equal tempered, or other traditional tuning algorithms. To eliminate a beat note would otherwise sometimes require such a great deviation from traditional harmony that the dissonances will be preferred over the retuning that would eliminate them. Since the energy contained in higher harmonics is generally less than the energy of lower ones, dissonances produced when higher harmonics do not coincide, yet tuning to eliminate dissonances caused by lower harmonics may require a greater degree of sharping or flatting. Thus conflicting objectives must be resolved.

When a sustained chord is detected, the chord type being sustained and its voicing are determined, for example, maj, dom 7, mi, ½ dim, and so on. An algorithm then determines which note, for example, the I note, in the chord is to be held at equal tempered tuning. All other notes are tuned with respect to that note. Any time any note(s) in the keyboard is (are) sharped or flatted, all of that (those) note's(s') octaves across the entire keyboard are sharped or flatted proportionally. The way the notes in sustained chords are retuned, that is, to vary from equal tempered tuning, is determined from, for example, a lookup table which classifies chords as to type and voicing. When a chord is no longer sustained, all notes in the entire keyboard return to their equal tempered relationships. When the type of chord being sustained changes, all notes are returned to equal tempered tuning, and then retuned to the next identified chord.

Different voicings of the same chord offer different tuning options and enhance those different tuning options in different ways. The high amplitude harmonics which are close in pitch change as the voicing of a chord changes. For example, if the I is above the III of the chord, then there are multiple options for tuning the III. For example, the III can be tuned 13.7¢ flat, so that its $8^{th}$ harmonic coincides with the $5^{th}$ harmonic of the I. Another alternative is to tune the III 17.5¢ sharp so that the $11^{th}$ harmonic of the III coincides with the $7^{th}$ harmonic of the I. If the I is below the III, the option to sharp the III 17.5¢ is not as good, since the $11^{th}$ harmonic of the III would have to coincide with the $14^{th}$ harmonic of the I. The $14^{th}$ harmonic naturally is considerably lower in amplitude than the $7^{th}$.

The I–III and the I–VIIb are both intervals which present a number of tuning options. Voicing affects the desirability of different tuning options. For example, a dom 7 chord voiced V, III, VIIb, I places the $7^{th}$ harmonic of I close to the $11^{th}$ th harmonic of III and produces a dissonance of moderate energy. If the III is sharped 17.5 cents, then its $7^{th}$ harmonic and the $11^{th}$ harmonic of I will coincide. If the VIIb is flatted 31.16¢ at the same time that III is sharped 17¢, then the $2^{nd}$ harmonic of VIIb, the $7^{th}$ harmonic of I, and the $11^{th}$ harmonic of III will all coincide. For some styles of music this tuning may be more desirable than so-called "just" tuning, wherein III is flatted 13.7¢. In other voicings such as I, *, III, V, VIIb where the * indicates a skipped octave, the option of flatting III by 13.7¢ may be preferred because with this voicing the sharping option aligns the $14^{th}$ (not the $7^{th}$) harmonic of I with the $11^{th}$ harmonic of III, thus producing a less energetic overtone. Table VI illustrates some options for tuning the maj III interval when it is voiced I, III, when it is voiced III, I, and when it is voiced I * III (skipped octave). Table VII illustrates some options for tuning the I–VIIb interval when it is voiced: I, VIIb; VIIb, I; and I * VIIb.

TABLE VI

Major III Interval Tuning-Voicing Options and Consequences

| Interval Pair and Voicing | Tuning Option | Harmonics Aligned | Tendency to Lock and Prominence of Overtones | Note Aug-mented | Possible Consequences |
|---|---|---|---|---|---|
| I, III | Flat III by 13.7¢ | $5^{th}$ of I w/ $4^{th}$ of III | Very High | V | May sound |
| III, I | Flat III by 13.7¢ | $5^{th}$ of I w/ $8^{th}$ of III | High | V | slightly |
| I * III | Flat III by 13.7¢ | $5^{th}$ of I w/ $2^{nd}$ of III | Very High | V | minor |
| I, III | Sharp III by 17.5¢ | $14^{th}$ of I w/ $11^{th}$ of III | Very Low | VII♭ | May sound |
| III, I | Sharp III by 17.5¢ | $7^{th}$ of I w/ $11^{th}$ of III | Medium | VII♭ | brightly |
| I * III | Sharp III by 17.5¢ | $28^{th}$ of I w/ $11^{th}$ of III | None | VII♭ | major |
| I, III | Sharp III by 34.3¢ | $9^{th}$ of I w/ $7^{th}$ of III | Low | IX | May sound |
| III, I | Sharp III by 34.3¢ | $9^{th}$ of I w/ $14^{th}$ of III | Very Low | IX | annoyingly |
| I * III | Sharp III by 34.3¢ | $18^{th}$ of I w/ $7^{th}$ of III | Very Low | IX | sharp |
| All Voicings | Leave Equal-tempered Tuning | None | 0 | None | Consistent with eq. temp. tuning |

TABLE VII

VII♭ Tuning-Voicing Options and Possible Consequences

| Interval Pair and Voicing | Tuning Option | Harmonics Aligned | Tendency to Lock an Prominence of Overtones | Note Aug-mented | Possible Consequences |
|---|---|---|---|---|---|
| I, VII♭ | Flat VII♭ by 31.2¢ | $7^{th}$ of I w/ $4^{th}$ of VII♭ | Very High | VII♭ | May sound |
| VII♭, I | Flat VII♭ by 31.2¢ | $7^{th}$ of I w/ $8^{th}$ of VII♭ | High | VII♭ | flat in some |
| I * VII♭ | Flat VII♭ by 31.2¢ | $7^{th}$ of I w/ $2^{nd}$ of VII♭ | Very High | VII♭ | voicings |
| I, VII♭ | Flat VII♭ by 3.9¢ | $16^{th}$ of I w/ $9^{th}$ of VII♭ | Low | I | May sound |
| VII♭, I | Flat VII♭ by 3.9¢ | $8^{th}$ of I w/ $9^{th}$ of VII♭ | Medium High | I | right on |
| I * VII♭ | Flat VII♭ by 3.9¢ | $32^{nd}$ of I w/ $9^{th}$ of VII♭ | 0 | I | pitch |
| I, VII♭ | Sharp VII♭ by 17.6¢ | $9^{th}$ of I w/ $5^{th}$ of VII♭ | High | IX | May sound |
| VII♭, I | Sharp VII♭ by 17.6¢ | $9^{th}$ of I w/ $10^{th}$ of VII♭ | Medium | IX | brightly major or |
| I * VII♭ | Sharp VII♭ by 17.6¢ | $18^{th}$ of I w/ $5^{th}$ of VII♭ | Very Low | IX | slightly sharp |
| All Voicings | Leave Equal-tempered Tuning | None | 0 | None | Consistent with eq. temp tuning |

*Indicates an octave has been skipped
¢ = cents
$1¢ = (2 \times S)^{1/1200}$

When tuning a dom 7 chord, combinations of options, for example, those shown in Tables IV and V, can be selected. The combinations selected will likely be different for different styles of music. For blues, early jazz, gospel and other music heavily influenced by African tuning, the options selected for most voicings and spreads may emphasize flatting the III by 13.7 cents and flatting the VIIb by 31.2 cents. For classical music, for most voicings and spreads, the tendency may be to sharp the III by 17.6 cents, or keeping it equal tempered, and either keep the VIIb at equal-tempered tuning or flat it by 3.9 cents. For barbershop harmonies voiced with I below III, the choice may be to flat III by 13.7 cents and flat VIIb by 31.2 cents or by 17.6 cents. For barbershop harmonies voiced V, III, VIIb, the choice may be to sharp III by 17.5 cents and flat VIIb by 31.2 cents.

A device or devices together with an algorithm will play synthesized, naturally produced and/or recorded music and will permit the notes of music to be sharped or flatted by specified amounts as chord types with various voicings and spreads are sounded. Expert musicians, music critics, music conductors and the like, listen to various optional tuning strategies developed for various styles of music, for example, gospel, blues, nineteenth century classical, modem jazz, and so on, and for various types of ensembles, for example, choral groups, string quartets and so on. Strategies developed from such critical listening are implemented in tuning/blending databases, for example, for each of such styles of music. Such a database will contain tuning and blending strategies for each voicing, including spread voicings, of each chord type. All of the eleven 2-note chords, including the common voicings and spreads which might be tuned by expert ensembles; all triads and their voicings; all 4-note chords and their voicings; and all the more common 5-note chords and their more common voicings are included in the tuning/blending database. The tuning options described after Tables IV and V are some options which apply to a dom 7 chord. Hereafter a dom 7 chord will be used to illustrate a tuning/blending database.

There are many possible voicings of a dom 7 chord. When the root (I) is the lowest note of the chord, there are 6 compact voicings, that is, voicings in which no octaves are skipped between notes of the chord. These compact voicings are:

| | | | |
|---|---|---|---|
| I | III | VI♭ | V |
| I | III | V | VI♭ |
| I | VI♭ | III | V |
| I | VI♭ | V | III |
| I | V | III | VI♭ |
| I | V | VI♭ | III. |

There are eighteen more compact voicings with III, V and VIIb being the lowest note, and there are quite a few spread versions of these voicings (that is, voicings in which an octave is skipped between adjacent notes of the chord), such as

| | | | | | |
|---|---|---|---|---|---|
| I | * | III | V | VI♭ | and |
| I | * | III | * | V | VI♭ |

Consequently, there may be as many as 100 voicings of the dom 7 chord, and each is a separate entry in the database. A tuning strategy is provided for each entry in the database. That tuning strategy includes which note is to be held at equal tempered tuning, and the ratios of all notes with respect to the note that is held at equal tempered tuning. For example, the strategy for tuning a dom 7 voiced I * III V VIIb, for the blues being sung by a vocal group may be to set I (the root) equal tempered, III 13.6 cents flat with respect to its equal tempered frequency, V 2 cents sharp with respect to its equal tempered frequency, and VIIb 31.2 cents flat with respect to its equal tempered frequency. It should be understood that, as used here, equal tempered tuning includes equal tempered stretch tuning as previously described.

Figure 3:
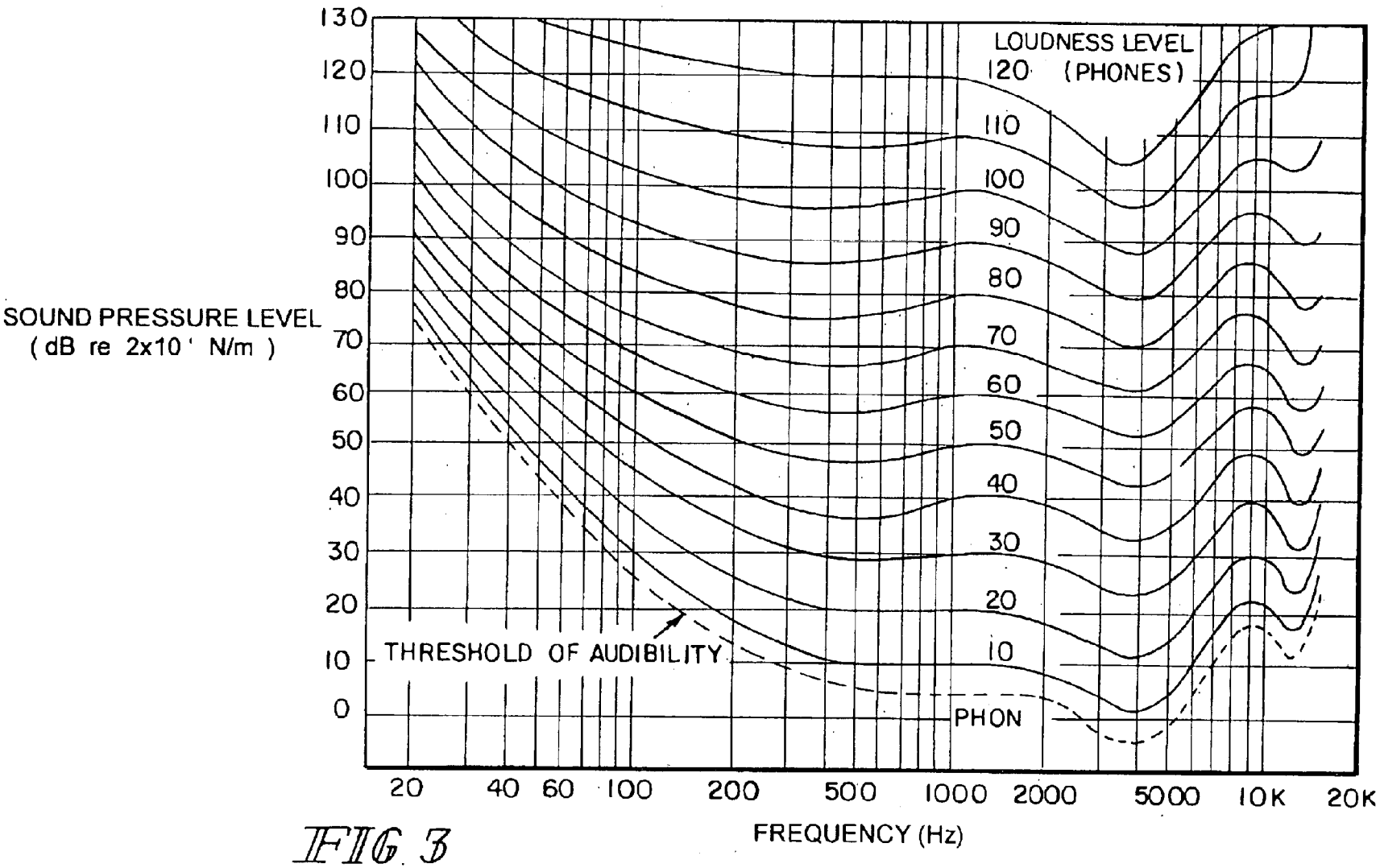
FIG. 3 illustrates a set of loudness contours useful in understanding an aspect of the invention.

Each tuning/blending database entry also contains a blending strategy, which again may be arrived at, for example, by experts listening to synthesized and/or modified recorded chords. Each blending strategy will indicate how many dB above or below some reference level, for example, equal loudness, the amplitude of each note should be set. There is a control, for example, a pedal, to activate and deactivate the blending function. When the blending function is not activated, the volume of each note will be controlled in a conventional manner, for example, by the force applied to the key, a volume setting, or the like. When the blending function is activated, the volume of each note in a combination of sustained notes is set by the instrument to blend the chord, that is, to adjust the amplitudes of the various notes of the chord so that no individual note(s) dominate(s) the sound. When the blending function is activated, the blending device/algorithm takes into account the following parameters in adjusting relative amplitudes of the various notes of the chord which is to be blended. Loudness is the listener's subjective response to the energy and frequency of a note. The psychoacoustics of perceived loudness have been the subject of considerable study, including that leading up to the publication of the equal loudness contours, illustrated in FIG. 3 ("the Physics of Musical Instruments", p. 162, $2^{nd}$ Ed.). This phenomenon has been studied in depth and the equal loudness contours have been developed to illustrate the relationship among perceived loudness (in phons), sound pressure level (in dB) and frequency (in Hertz). Using these, or similar, curves, the relative amplitudes of two notes of different frequency can be established so that neither note dominates. The equal loudness contours, or similar curves, may be stored in the instrument and employed in calculations by the instrument to determine the desired amplitudes of the blended notes of a played chord when the blending function is selected on the instrument.

The positions occupied by the various notes in a chord also affect the blending of the notes. Certain intervals in certain chords voiced in certain ways will blend only when their volumes are adjusted, beyond even the observations exemplified by the equal loudness contours. In general, it is frequently desirable to reduce substantially the volume of a minor seventh, to reduce a major third a moderate amount, and to reduce a sixth and a minor third lesser amounts. These reductions may be mediated by the way the chord is voiced.

Voicing of the chord also affects the blending of notes. In general, if two notes are located less than three semitones apart, then their volumes should be substantially equal. Thirds which are internal to a chord can be reduced in volume. Minor sevenths which are internal to a chord and separated from other notes by at least three semitones, and minor sevenths at the top of the chord can be substantially reduced in volume. The volumes of major and minor thirds can be reduced even more when they are within or at the top of a chord and widely separated from other notes.

The blending device/algorithm will utilize a table, such as Table VI, containing deviations from, for example, the equal loudness contours, to which the instrument's processor will refer to blend the notes of a played chord once the loudnesses, note positions and voicing have been determined. In the context of tuning, once it has been determined that a chord is being sustained, the notes in a newly sustained chord are identified. The chord type is identified and the position of each note in the chord is determined, for example, by looking it up in a lookup table. The amplitude of the note having the lowest frequency in the sustained chord is recorded. A loudness curve by which the amplitudes of the various notes of the chord are to be blended is selected. Such a loudness curve may be, for example, an equal loudness contour based upon the frequency and amplitude of the lowest frequency note in the chord and established by interpolation between curves in FIG. 3. The amplitude of each other note in the chord is then set relative to the amplitude for the lowest frequency note. As another method for blending, the contents of the equal loudness contours or some other suitable amplitude adjusting algorithm can be stored in a lookup table with an appropriate interpolation engine, with the amplitudes of the notes of the chord being adjusted as dictated by the contents of the table with the aid of the interpolation engine. Table VIII illustrates one method for adjusting the amplitudes of the various notes of several chords voiced in several different ways relative to the equal loudness contour amplitude, v, of a reference note of the chord. Notes of the illustrated chords whose amplitudes are adjusted downward by some number of dB relative to v are indicated, for example, "−2.0" indicating a downward adjustment of amplitude by 2 dB relative to v. This blending of amplitudes will be maintained as long as the chord is sustained or until the blending pedal is released.

The entries in Table VIII are for the purpose of illustration only. Musicians who are chord blending specialists, for example, barbershop chorus or quartet directors and coaches, and string quartet instructors and advisors, can listen to the suggested blendings in Table VIII and adjust values, or suggest adjustments to values, such as those contained in Table VIII to produce chords with notes that, in their judgment, blend well. Consensus among experts can be used to establish blending values for the notes of various chords voiced in various ways. These consensus values can be incorporated into blending tables, like Table VIII, which are incorporated into instruments constructed according to this invention.

TABLE VIII

BLENDING TABLE
DEVIATIONS FROM EQUAL LOUDNESS CONTOURS
FOR VARIOUS CHORDS VOICED IN VARIOUS WAYS

Legend:

| | |
|---|---|
| R | Root |
| 3 | major 3rd |
| mi | minor |
| v | Equal loudness contour value |
| −x | Sound pressure level reduced from equal loudness contour's v by x dB (referenced to $2 \times 10^5$ N/m$^2$) |

| | | | | | | | | | | |
|---|---|---|---|---|---|---|---|---|---|---|
| | | | ←Octave→ | | | | | ←Octave→ | | |
| MAJOR | R | | 3 | | 5 | | | | | |
| | v | | −2.5 | | v | | | | | |
| | R | | | 5 | | | | 3 | | |
| | v | | | v | | | | −3.0 | | |
| | | | 5 | | | | | R | 3 | |
| | | | v | | | | | v | −3.0 | |
| | | | R | | | | | 3 | | 5 |
| | | | v | | | | | −2.0 | | v |
| MINOR | R | | mi3 | | 5 | | | | | |
| | v | | −2.0 | | v | | | | | |
| | R | | | 5 | | | | mi3 | | |
| | v | | | v | | | | −2.0 | | |
| | | | 5 | | | v | R | | mi3 | |
| | | | | | | | v | | −1.5 | |
| | | | R | | | | mi3 | | 5 | |
| | | v | | | | −1.0 | | v | | |
| DOMINANT 7TH | R | 3 | 5 | mi7 | | | | | | |
| | v | −2.0 | v | −3.0 | | | | | | |
| | | | 5 | | | 3 | mi7 | R | | |
| | | | v | | | −2.0 | v | v | | |
| | R | | 5 | mi7 | | 3 | | mi7 | | |
| | v | | v | −3.0 | | −4.0 | | | | |
| | | R | | | 3 | 5 | mi7 | | | |
| | | v | | −2.0 | v | −3.0 | | | | |
| | R | | 5 | | 3 | | mi7 | | | |
| | v | | v | | −4.0 | | −5.0 | | | |
| | | | 5 | | | R | 3 | mi7 | | |
| | | | v | | | v | −2.0 | −5.0 | | |
| MAJOR 6TH | R | 3 | 5 | 6 | | R | | | | |
| | v | −2.0 | v | v | | | | | | |
| | | | 5 | | | R | | 3 | 6 | |
| | | | v | | | v | −3.0 | −2.0 | | |
| | R | | 5 | 6 | | | 3 | | | |
| | v | | v | v | | | −4.0 | | | |
| | | 5 | 6 | | | R | 3 | | | |
| | | v | v | | | v | −3.0 | | | |
| MAJOR 7TH | R | 3 | | 5 | | 7 | | | | |
| | v | | −2.0 | | v | −2.0 | | | | |
| | R | | 5 | | 7 | | 3 | | | |
| | v | | v | | −2.0 | | −3.0 | | | |
| | | 5 | | 7 | | | R | 3 | | |
| | | v | | v | | | v | | −3.0 | |
| | 3 | | 5 | | 7 | | R | | | |
| | v | | v | | v | | | v | | |
| MINOR 7TH | R | | mi3 | 5 | mi7 | | | | | |
| | v | | −1.5 | v | −3.0 | | | | | |
| | R | | 5 | | mi7 | | mi3 | | | |
| | v | | v | | −3.0 | | −2.0 | | | |
| DIMINISHED | The amplitude is v for all notes in all of these chords regardless of how the chords are voiced. | | | | | | | | | |
| AUGMENTED | | | | | | | | | | |
| SUSPENDED | | | | | | | | | | |
| DOMINANT 7TH WITH | R | | 3 | | 5 | mi7 | | | 9 | |
| | v | | −1.5 | | v | | −3.0 | | −1.5 | |

TABLE VIII-continued

BLENDING TABLE
DEVIATIONS FROM EQUAL LOUDNESS CONTOURS
FOR VARIOUS CHORDS VOICED IN VARIOUS WAYS

| | | | | | | | | | | |
|---|---|---|---|---|---|---|---|---|---|---|
| ADDED 9TH | | | | | | | | | | |
| | | 5 | | mi7 | | R | | 9 | | 3 |
| | | v | | v | | v | v | v | | |
| | | 9 | | mi7 | | R | 3 | 5 | | |
| | | v | | v | | v | −3.0 | v | | |
| | R | | 5 | | mi7 | | 9 | | 3 | |
| | v | | v | | −2.0 | | v | v | | |
| MINOR 6TH | R | | mi3 | | 5 | 6 | | | | |
| (See note 1) | v | −1.5 | v | v | | | | | | |
| | | | 5 | | | R | mi3 | 6 | | |
| | | | v | | | v | −1.5 | −1.0 | | |
| | | R | | 5 | | | mi3 | | 6 | |
| | | v | | v | | | −2.0 | | −1.0 | |

Note 1: Logic will decide between a mi 6 chord and a ½ dim chord based upon, for example, the type of music being played, as noted above, and blend the various voicings of each.

What is claimed is:

1. A method of tuning notes in a chord comprising:

receiving activated notes;

determining a sustained chord as a group of activated notes whose time of activation exceeds a threshold;

determining a chord type from the group of the activated notes of the sustained chord;

determining the chord interval positions occupied by each of the notes of the sustained chord, and the order and spread of the interval positions; and tuning selected notes of the group based on the determined chord type and order and spread of the interval positions in the chord.

2. The method according to claim 1, including using relative energies of harmonics of the activated notes in the tuning step.

3. The method according to claim 1, wherein tuning includes selecting the notes to tune based on dissonances produced by combinations of harmonics of the actuated notes.

4. The method according to claim 1, wherein the threshold is dynamic and a function of the history of the amount of time the activated notes have been sustained continuously.

5. The method according to claim 1, including accumulating a history of the notes, and tuning using the accumulated history of the notes.

6. The method according to claim 5, wherein the history includes the amount of time the note has been sustained continuously in total and the percentage of that time the note has been sustained in each chord interval position.

7. The method according to claim 1, wherein the method is performed on a programmed machine.

8. The method according to claim 1, including receiving the activated notes as inputs tuned to a first scale and the tuning step retunes selected notes of the first scale.

9. The method according to claim 8, including tuning the retuned notes back to the first scale when the chord is no longer sustained.

10. The method according to claim 1, including obtaining a plurality of tuning strategies, selecting one of the tuning strategies, and tuning using the selection.

11. The method according to claim 10, wherein the tuning strategies includes a style of music and/or a type of ensemble, and tuning using the selection.

12. The method according to claim 1, including determining the amplitude of the notes of the chord; and blending by selectively adjusting the amplitude as a function of one or more of the amplitude, the determined chord type, the determined order of the interval positions in the chord and the determined spread of the interval positions in the chord.

13. The method according to claim 12, including obtaining a plurality of blending strategies, selecting one of the blending strategies, and blending using the selection.

14. A method of determining a sustained chord from a group of notes comprising:

receiving notes;

determining the amount of time each note has been sustained and keeping a history of the amount of time notes in the group have been sustained;

comparing the amount of time to a threshold value which is dynamic and is a function of the history of the amount of time notes in the group have been sustained;

determining a sustained cord type from notes whose amount of time exceed the threshold.

15. A musical device comprising:

an input for notes tuned to a first scale;

a retuning engine which determining a sustained chord as a group of inputted notes whose time of activation exceeds a threshold, which determines chord type of sustained chord, a chord interval position occupied by the notes of the sustained chord, and the order and spread of the interval positions, and which retunes selected inputted notes based on the determined chord type and order and spread of the interval positions in the chord; and an output for retuned and non-retuned inputted notes.

16. The device according to claim 15, wherein the engine uses relative energies of harmonics of the inputted notes for the retuning.

17. The device according to claim 15, wherein the engine selects the notes to retune based on dissonances produced by combinations of harmonics of the inputted notes.

18. The device according to claim 15, wherein the threshold is dynamic and a function of the history of the amount of time the inputted notes have been sustained continuously.

19. The method according to claim 15, wherein the engine retuning using an accumulated history of the inputted notes, and the history includes the amount of time the note has been sustained continuously in total and the percentage of that time the note has been sustained in each chord interval position.

20. The method according to claim 15, wherein the engine includes a plurality of tuning strategies, the tuning strategies includes a style of music and/or a type of ensemble, and the engine retunes using a selected tuning strategies.

21. The method according to claim 15, wherein the engine includes determining the amplitude of the notes of the chord; and blending by selectively adjusting the amplitude as a function of one or more of the amplitude, the determined chord type, the determined order of the interval positions in the chord and the determined spread of the interval positions in the chord.

22. The method according to claim 21, wherein the engine includes a plurality of blending strategies and blendes using a selected blending strategy.

* * * * *